US006127905A

United States Patent [19]

Horie

[11] Patent Number: 6,127,905

[45] Date of Patent: Oct. 3, 2000

[54] DIELECTRIC FILTER AND METHOD FOR ADJUSTING BANDPASS CHARACTERISTICS OF SAME

[75] Inventor: Kenichi Horie, Machida, Japan

[73] Assignee: U.S. Philips Corporation, New York, N.Y.

[21] Appl. No.: 09/183,379

[22] Filed: Oct. 30, 1998

[30] Foreign Application Priority Data

Oct. 30, 1997 [JP] Japan ..... 9-316117

[51] Int. Cl.[7] ..... H01P 1/203

[52] U.S. Cl. ..... 333/204; 333/205; 333/185

[58] Field of Search ..... 333/204, 219, 333/175, 185, 205

[56] References Cited

U.S. PATENT DOCUMENTS

| | | | |
|---|---|---|---|
| 5,374,909 | 12/1994 | Hirai et al. | 333/204 |
| 5,406,235 | 4/1995 | Hayashi | 333/204 |
| 5,489,881 | 2/1996 | Yuda et al. | 333/204 X |

FOREIGN PATENT DOCUMENTS

| | | | |
|---|---|---|---|
| 0 429 067 A2 | 5/1991 | European Pat. Off. | 333/204 |
| 0641035A2 | 3/1995 | European Pat. Off. | H01P 1/203 |
| 4-246901 | 9/1992 | Japan | 333/204 |
| 4-284003 | 10/1992 | Japan | 333/204 |
| 7312503 | 11/1995 | Japan | H01P 1/203 |
| 470-880 | 9/1975 | U.S.S.R. | 333/204 |
| WO9619843 | 6/1996 | WIPO | H01P 1/203 |

*Primary Examiner*—Robert Pascal
*Assistant Examiner*—Barbara Summons
*Attorney, Agent, or Firm*—Dicran Halajian

[57] ABSTRACT

A dielectric filter (10) comprises two stripline resonators (20, 40) which are arranged on parallel planes, respectively, with dielectric layers (10*d*, 10*e*) being sandwiched therebetween and are electromagnetically coupled to each other. Each of the two stripline resonators (20, 40) comprises a first stripline portion grounded at a proximal end thereof and a second stripline portion extending from a distal end of the first stripline portion in the same direction as the first stripline portion extends. The width of the first stripline portion is slightly less than that of the second stripline portion. Side edges of the second stripline portion is shifted relative to respective side edges of the first stripline portion in the same direction which is perpendicular to the direction in which the first and second stripline portions extend. A generally rectangular notch extends in the second stripline portion from one side edge thereof.

9 Claims, 5 Drawing Sheets

DIELECTRIC FILTER AND METHOD FOR ADJUSTING BANDPASS CHARACTERISTICS OF SAME

FIELD OF THE INVENTION

The present invention generally relates to dielectric filters suitable for use in high-frequency wireless apparatuses such as mobile telephones and particularly to a miniature chip-type dielectric filter which is constructed by laminating dielectric layers with a plurality of electrodes sandwiched therebetween. The present invention also relates to a method of adjusting bandpass characteristics of such a dielectric filter.

BACKGROUND OF THE INVENTION

There is an increasing demand of miniaturizing high-frequency filters for use in portable radio communication apparatuses such as mobile telephones. Such a high-frequency filter should have a good frequency selectivity and at the same time must be able to be manufactured at low cost. There has been proposed, as a high-frequency filter which meets the above demands, a ceramic filter of the multilayer structure in which stripline electrodes are arranged as resonators (refer, for example, to WO96/19843). This type of dielectric filter is advantageous in that its size can be reduced since effective wavelengths of the signals used therein become shorter by virtue of the high dielectric constant of the ceramic dielectric materials used, whereby the lengths of the resonators can be shorter.

A dielectric filter of the above type in which dielectric materials of high dielectric constants are used, however, has a disadvantage that its frequency characteristics are largely affected by a small change in size of the electrodes provided therein. For this reason, dielectric constants of dielectric materials used in this type of dielectric filters are limited by a certain upper value which typically is about 100. As a dielectric filter which can further be reduced in size with a dielectric material having such a limited dielectric constant, a dielectric filter of the so-called SIR (Stepped Impedance Resonator) type having resonator electrodes of specially designed shapes has been proposed, for example, in Japanese Patent Application Laid-Open No. 7-312503. Each resonator of the SIR type comprises a narrow first resonator portion (of high impedance) which is grounded at its proximal end and a wider second resonator portion (of low impedance) which adjoins a distal end of the first resonator portion, the second resonator portion being open at its distal end. The resonators of such SIR type can be shorter at the same frequency, so that the filter can further be reduced in size. However, the dielectric filter of the above-described SIR type is disadvantageous in that concentrations of currents at the narrow first resonator portions of the resonators result in a substantial loss, which causes the insertion loss of this filter to increase.

SUMMARY OF THE INVENTION

It is therefore an object of the present invention to provide a dielectric filter of the SIR type which is small in size and has a low insertion loss.

It is another object of the present invention to provide a dielectric filter whose frequency characteristics can be adjusted in an easy manner.

It is a further object of the present invention to provide a method of adjusting bandpass characteristics of such a dielectric filter easily and finely.

In order for achieving the above objects, a dielectric filter according to the present invention is characterized in that, in a dielectric filter comprising at least two stripline resonators which are arranged on parallel planes, respectively, with at least one dielectric layer being sandwiched therebetween and are electromagnetically coupled to each other, each of the at least two stripline resonators comprises a first stripline portion grounded at a proximal end thereof and a second stripline portion extending from a distal end of the first stripline portion in the same direction as the first stripline portion extends, a width of the first stripline portion being slightly less than that of the second stripline portion, side edges of the second stripline portion being shifted relative to respective side edges of the first stripline portion in the same direction which is perpendicular to the direction in which the first and second stripline portions extend.

With the filter having the above structure, since the width of the first stripline portion of the stripline resonator is only slightly smaller than that of the second stripline portion, this first stripline portion will have a current density which is lower than that in the conventional SI-type resonator and have therefore a lower loss. Thus, this filter will have a lower insertion loss.

The above-described dielectric filter according to this invention may have at least one cut-out of a generally square shape formed in the second stripline portion of at least one of the stripline resonators at at least one of side edge portions thereof. By the provision of these cuts-out, additional inductance and capacitance are developed in these resonators, so that the center frequency of this filter can be lowered and, in addition, the cutting-off characteristic will be improved. Furthermore, It will be possible to finely adjust the bandpass characteristics of this filter by the adjustment of positions, depths and/or widths of these cuts-out.

The dielectric filter according to this invention may have at least one strip-like tuning electrode on at least one of the dielectric layers sandwiched between the stripline resonators for the adjustment of the electromagnetic coupling between the stripline resonators, at most one of ends of the at least one strip-like tuning electrode being grounded. With this structure, it will be possible to finely adjust the bandpass characteristics of this filter.

The dielectric filter according to this invention may have at least one further dielectric layer disposed outwardly of the stripline resonators on which a capacitive electrode is provided for capacitively coupling to the second stripline portion of at least one of the stripline resonators. With this structure, it will be possible to lower and/or adjust the center frequency of this filter.

A method for adjusting the bandpass characteristics of such a filter according the present invention is characterized in that a depth, a width and/or a position of the cut-out in the relevant second stripline portion is adjusted. According to this method, the bandpass characteristics of this filter can easily and finely be adjusted.

BRIEF DESCRIPTION OF THE DRAWINGS

Embodiments of the present invention will hereinafter be described with reference to the accompanying drawings in which.

DETAILED DESCRIPTION OF EMBODIMENTS OF THE INVENTION

Figure 1:
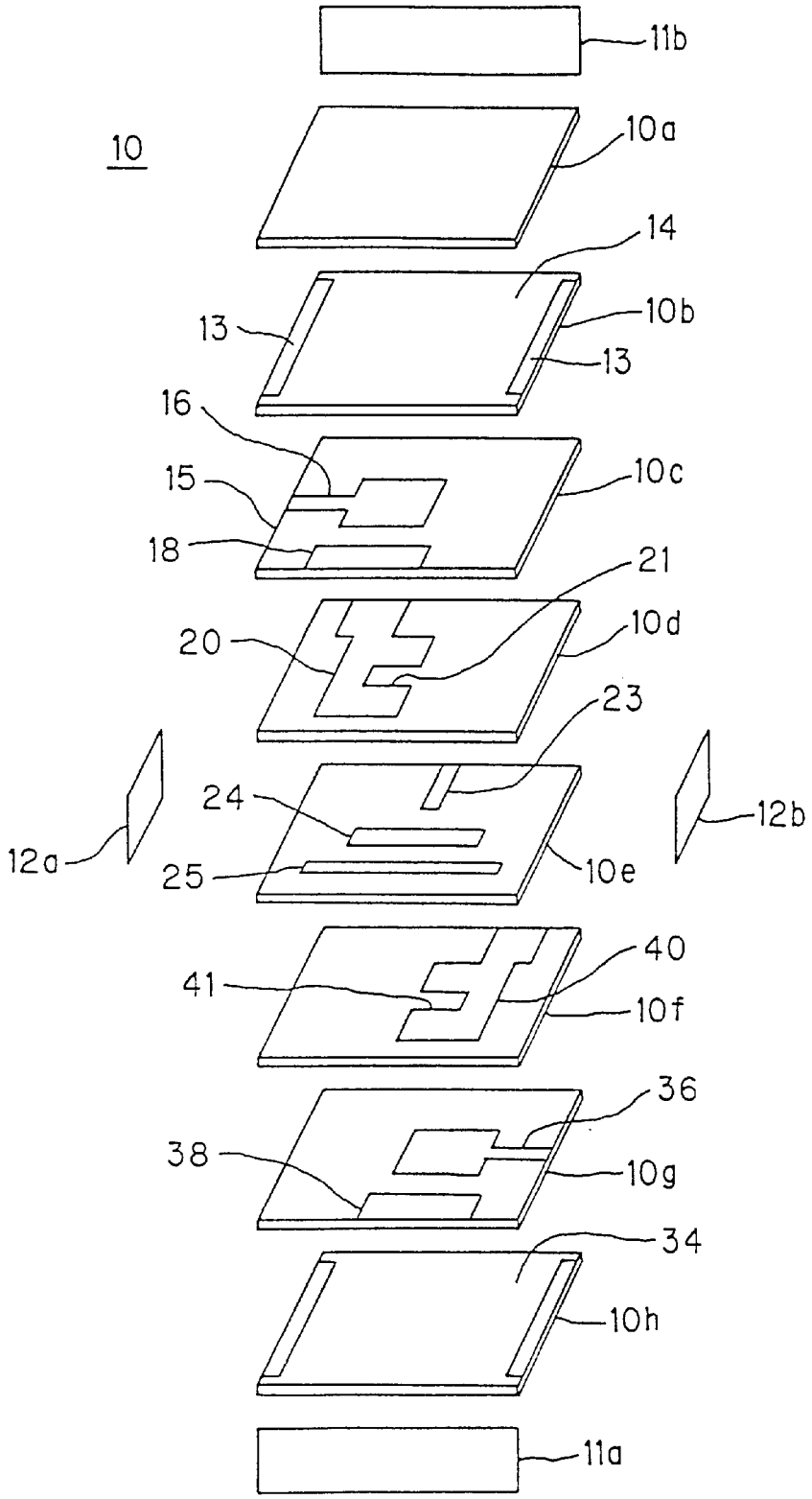
FIG. 1 is a perspective exploded view of a dielectric filter according to a first embodiment of the invention.
Figure 2:
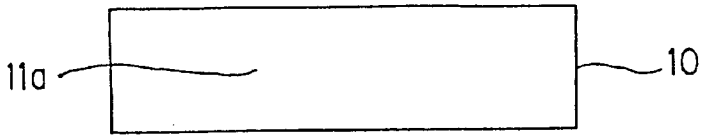
FIG. 2 is a front view of the embodiment of FIG. 1.
Figure 3:
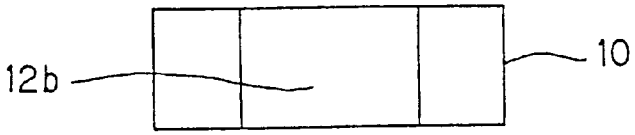
FIG. 3 is a right-hand side view of the embodiment of FIG. 1.
Figure 4:
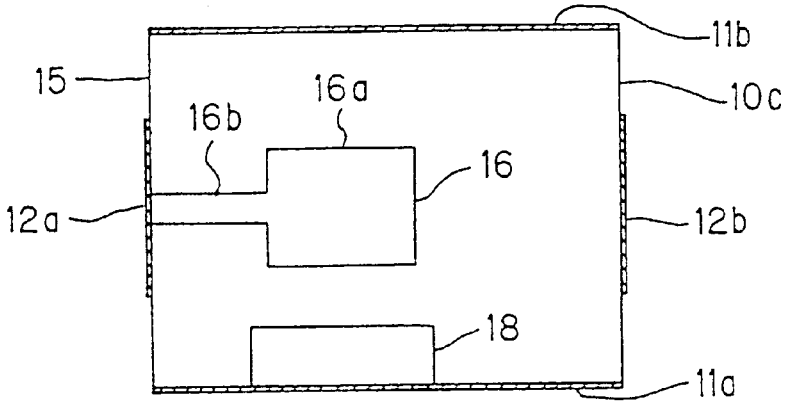
FIG. 4 is a plan view of the dielectric layer 10*c* of the embodiment of FIG. 1.
Figure 5:
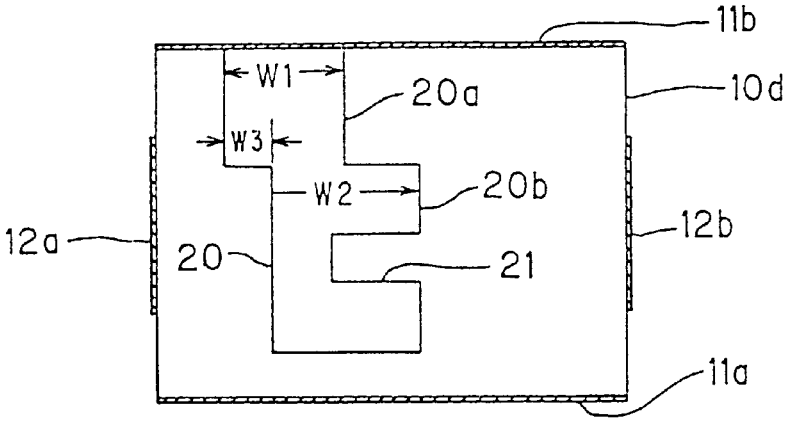
FIG. 5 is a plan view of the dielectric layer 10*d* of the embodiment of FIG. 1.
Figure 6:
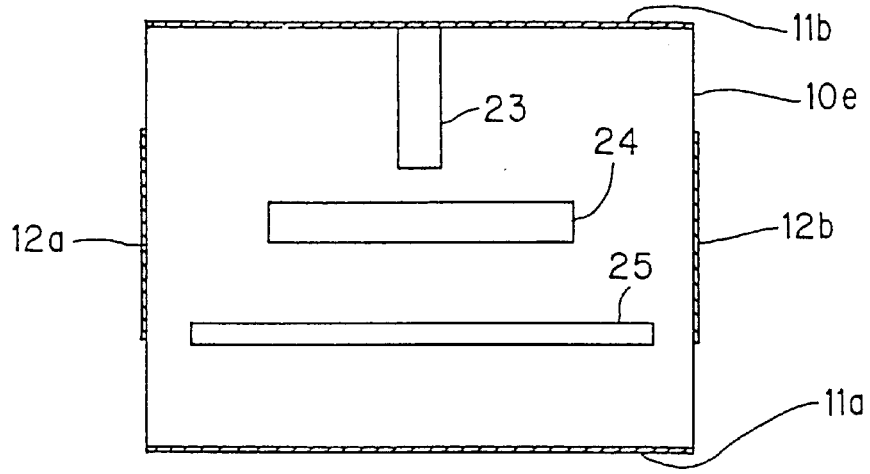
FIG. 6 is a plan view of the dielectric layer 10*e* of the embodiment of FIG. 1.
Figure 7:
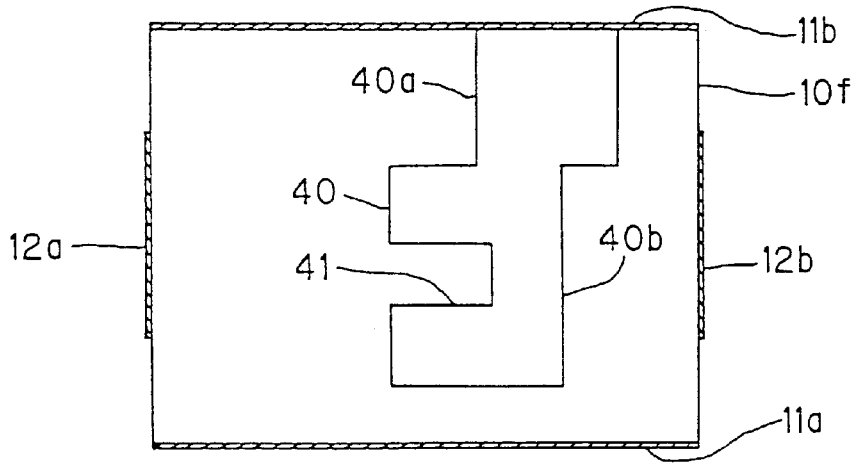
FIG. 7 is a plan view of the dielectric layer 10*f* of the embodiment of FIG. 1.
Figure 8:
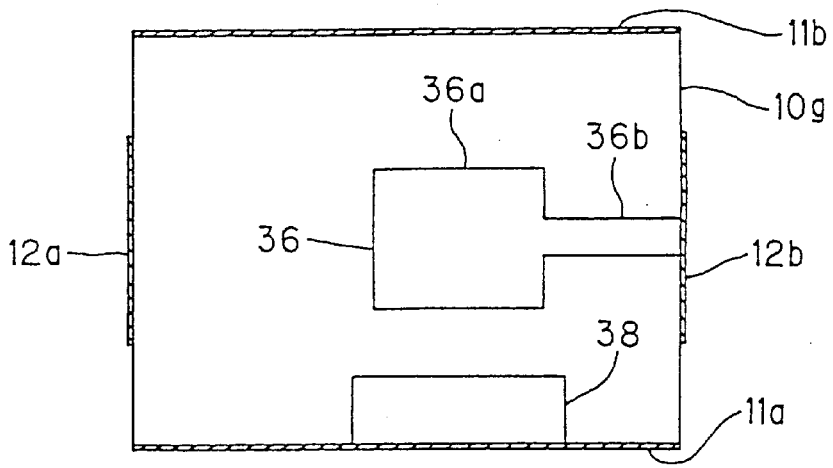
FIG. 8 is a plan view of the dielectric layer 10*g* of the embodiment of FIG. 1.

FIGS. 1 to 8 show a dielectric filter 10 according to the first embodiment of the present invention. This filter is of the block type (or the chip type) and is constructed by laminating and sintering eight rectangular dielectric sheets 10*a* to 10*h* with a plurality of thin film metal electrodes sandwiched therebetween. Each sheet is made of a ceramic material and has a respective predetermined thickness. The filter 10 is provided on a pair of opposite side faces thereof (one of these side faces is shown in FIG. 2) respectively with ground terminal electrodes 11*a* and 11*b* each of which entirely covers the relevant side face. The filter 10 is further provided on another pair of opposite side faces (one of these side faces is shown in FIG. 3) respectively with strip-like input/output terminal electrodes 12*a* and 12*b* each of which extends in the central portion of the relevant side face in the direction of thickness of the filter 10.

The dielectric sheet 10*a* located on the side of one of the surfaces of this filter (the upper surface in FIG. 1) is provided for the protection purpose. The protective dielectric sheet 10*a* adjoins the dielectric sheet 10*b* which is provided on its surface facing the sheet 10*a* with a shield electrode 14 which substantially entirely covers the surface except for its marginal portions 13 and 13 extending along opposite sides (shorter sides in FIG. 1) of the sheet 10*b*. The marginal portions 13 and 13 are provided for preventing the shield electrode 14 from short circuiting with the input/output terminal electrodes 12*a* and 12*b*.

The dielectric sheet 10*b* adjoins the dielectric sheet 10*c* which is provided on its surface facing the sheet 10*b* with an input electrode 16 which extends from a middle portion of that side of the sheet 10*c* adjoining the input terminal electrode 12*a* and designated by reference numeral 15 in a direction substantially perpendicular to the side 15. The input electrode 16 has a distal half 16*a* which is significantly wider than its proximal half 16*b*. The dielectric sheet 10*c* is provided on the same surface as above further with a strip-like capacitance electrode 18 extending along the side thereof which adjoins the ground terminal electrode 11*a*. The capacitance electrode 18 is disposed laterally of the distal half 16*a* of the input electrode 16.

The dielectric sheet 10*c* adjoins the dielectric sheet 10*d* which is provided on its surface facing the sheet 10*c* with a resonator electrode 20 which serves to function as a first stripline resonator. The resonator electrode 20 comprises a proximal resonator portion 20*a* which extends from a portion of that side of the sheet 10*d* which adjoins the ground terminal electrode 11*b* with a constant width w1 in a direction substantially perpendicular to this side, the portion of the side from which the proximal resonator portion 20*a* extends being shifted from the middle of the side towards the input terminal electrode 12*a*. The resonator electrode 20 further comprises a distal resonator portion 20*b* which extends from the distal end of the proximal resonator portion 20*a* with a constant width w2, which is slightly larger than the width of the proximal resonator portion 20*a*, in the same direction as that in which the proximal resonator portion 20*a* extends. The distal end of the distal resonator portion 20*b* assumes a square free end. An axis of the distal resonator portion 20*b* is shifted with respect to an axis of the proximal resonator portion 20*a* towards the output terminal electrode 12*b*, so that a side edge of the distal resonator portion 20*b* on the side of the input terminal electrode 12*a* is shifted by a distance w3 from a side edge of the proximal resonator portion 20*a* on the side of the input terminal electrode 12*a* towards the output terminal electrode 12*b*. The distance w3 may take any value greater than zero and in the case where the distance w3 is zero the side edge of the distal resonator portion 20*b* on the side of the input terminal electrode 12*a* is in alignment with the side edge of the proximal resonator portion 20*a* on the side of the input terminal electrode 12*a*. The distal end portion of the distal resonator portion 20*b* overlaps with the aforesaid capacitance electrode 18 when viewed in the direction of thickness of the filter 10. The distal resonator portion 20*b* is formed on the side of output terminal electrode 12*b* with a substantially square cut-out 21 of predetermined width and depth in a portion thereof which is disposed substantially centrally of this resonator portion in the direction of the length thereof.

The dielectric sheet 10*d* adjoins the dielectric sheet 10*e* which is provided on its surface facing the sheet 10*d* with a first strip-like tuning electrode 23, a second strip-like tuning electrode 24 and a third strip-like tuning electrode 25. The first tuning electrode 23 extends from a middle portion of that side of the sheet 10*e* which adjoins the ground terminal electrode 11*b* perpendicularly to this side towards the central part of this sheet. The second tuning electrode 24 is spaced a predetermined distance from the distal end of the above electrode 23 and extends over a predetermined length in a direction perpendicular to an axis of the electrode 23. The third tuning electrode 25 is spaced a predetermined distance from the electrode 24 towards the ground terminal electrode 11*a* and extends in parallel with the electrode 24.

The dielectric sheet 10*e* adjoins the dielectric sheet 10*f* which is provided on its surface facing the sheet 10*e* with an electrode 40 which is symmetrical with the electrode 20 on the dielectric sheet 10*d* with reference to an imaginary plane dividing the filter 10 into right and left halves in FIG. 1. The dielectric sheet 10*f* adjoins the dielectric sheet 10*g* which is provided on its surface facing the sheet 10*f* with electrodes 36 and 38 which are symmetrical respectively with the electrodes 16 and 18 on the dielectric sheet 10*c* with reference to the above-described imaginary plane. The electrode 40 on the dielectric sheet 10*f* which corresponds to the resonator electrode 20 constitutes a second stripline resonator of this filter and comprises a proximal resonator portion 40*a* and a distal resonator portion 40*b* in which a cut-out 41 is formed. The electrode 36 on the dielectric sheet 10*g* which corresponds to the input electrode 16 constitutes an output electrode of this filter, while the electrode 38 on the dielectric sheet 10*g* which corresponds to the capacitance electrode 18 constitutes a second capacitance electrode of this filter.

The dielectric sheet 10*h* adjoining the above dielectric filter 10*g* and disposed on the side of the other surface of this filter (the lower surface in FIG. 1) is provided for the protecting and shielding purposes. This dielectric sheet is provide its surface facing the sheet 10*g* with a shield electrode 34 similar to the shield electrode 14.

The function of the filter 10 having the above-described structure will now be described with reference to its equivalent circuit.

Figure 9:
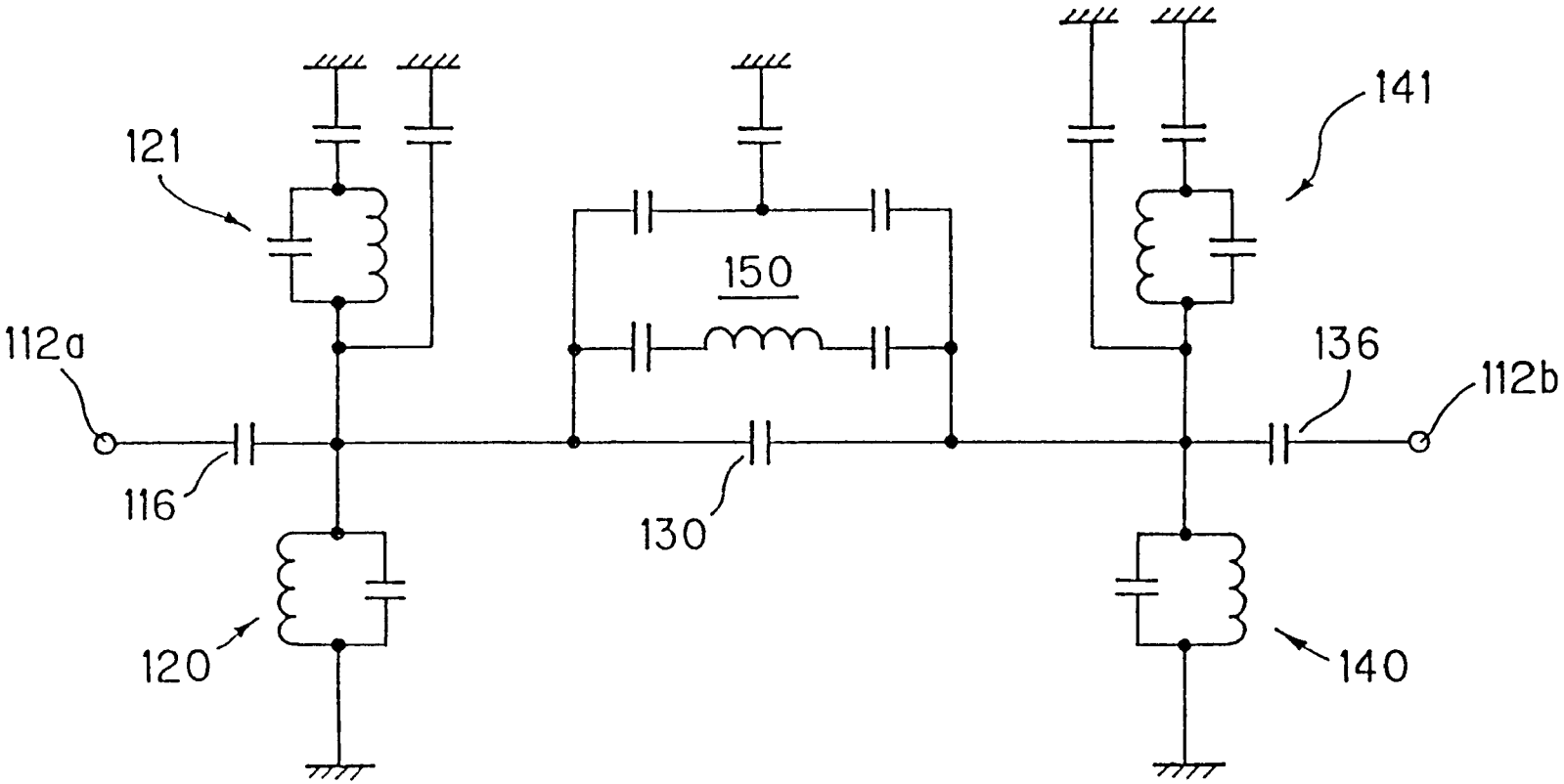
FIG. 9 is a diagram of an equivalent circuit of the embodiment of FIG. 1.

FIG. 9 shows an equivalent circuit of the dielectric filter 10 shown in FIGS. 1 to 8. As shown in FIG. 9, an input terminal 112*a* corresponding to the input terminal electrode 12*a* of the filter 10 is coupled through a capacitance 116 between the input electrode 16 and the resonator electrode 20 to a first resonance circuit 120 corresponding to the first resonator electrode 20. The non-grounded end of the resonance circuit 120 is coupled through a capacitance 130 between the two resonator electrodes 20 and 40 to a second resonance circuit 140 which corresponds to the second resonator electrode 40. The non-grounded end of the second resonance circuit 140 is coupled through a capacitance 136 between the resonator electrode 40 and the output electrode 36 to an output terminal 112*b* which corresponds to the output terminal electrode 12*b*.

In the above-described part of this equivalent circuit, since the resonator electrodes 20 and 40 have wider proximal resonator portions than resonators of the conventional SIR type filter, currents in these resonator portions are relatively low in density. Therefore, conduction losses at these resonators shown as the resonance circuits 120 and 140 in the relevant passband are low, so that an insertion loss of the filter 10 according to the present invention is substantially lower than that of the conventional SIR type filter. However, due to the increase in width of the proximal resonator portions of the resonator electrodes 20 and 40, these resonators have lower impedance, particularly smaller inductance components, than the conventional SI (Stepped Impedance) resonators. As a result, an effect of lowering the center frequency by the resonators of this filter 10 is smaller than that by the conventional SI resonators. For example, when the conventional SI resonators have an effect of lowering the center frequency by about 600 MHz as compared to the ordinary stripline resonators, the resonators of the filter 10 according to the present invention have an effect of lowering the center frequency only by about 400 MHz as compared to the ordinary stripline resonators.

In view of the above facts, the filter 10 according to this invention further comprises the capacitance electrodes 18 and 38 which not only serve to form additional capacitance with respect to the resonator electrodes 20 and 40 but also pull electron charges on the resonator electrodes 20 and 40 towards their open ends, thereby causing inductance components of these resonator electrodes to increase. Consequently, the resonance frequencies of the resonators shown as the resonance circuits 120 and 140 are lowered.

In the case where the center frequencies of the above resonators are lowered only by the provision of the capacitance electrodes 18 and 38, it will be very probable that small changes of distances between the capacitance electrodes 18 and 38 and the resonator electrodes 20 and 40 will cause the center frequencies to change significantly. For this reason, in the filter 10 according to the present invention, the capacitance electrodes are rather limited in size but, instead, the resonator electrodes 20 and 40 are provided in their distal resonator portions respectively with the cuts-out.

Since the distal resonator portions 20*b* and 40*b* of the resonator electrodes 20 and 40 are thus formed with cuts-out 21 and 41, currents in these resonator portions flow along edges of the respective cuts-out, as a result of which additional inductance and capacitance are developed in these resonators. Effects of these additional inductance and capacitance on the resonator electrodes 20 and 40 (hence on the resonance circuits 120 and 140) can be expressed as resonance circuits 121 and 141 which are coupled in parallel to the resonance circuits 120 and 140, respectively, as shown in FIG. 9. Thus, resonance frequencies of the resonator electrodes 20 and 40 are substantially lower as compared to the case where no cuts-out are provided. It will be appreciated that by changing positions, sizes (widths and depths) and/or other parameters of the cuts-out 21 and 41 the bandpass characteristics of the filter 10 can finely be adjusted. It will also be appreciated that since the cuts-out shown as resonance circuits 121 and 141 create attenuation poles in a frequency region disposed on the higher frequency side of the passband, the cutting-off characteristic of the filter 10 will be improved.

The electrodes 23, 24 and 25 provided on the sheet 10*e* of the filter 10 serve to adjust the coupling between the resonator electrodes 20 and 40 and can be expressed by an equivalent circuit 150 shown in FIG. 9. The electrodes 23, 24 and 25 create an attenuation pole in the cut-off frequency range. For example, the electrode 23 functions as a kind of notch filter and has a length shorter than those of the resonator electrodes 20 and 40. The electrode 23 therefore has its resonance point at a significantly higher frequency than the center frequency of the passband of the filter 10, whereby the cutting-off characteristic of the filter 10 is improved.

In the above-described embodiment, the cuts-out 21 and 41 are provided in the distal resonator portions of the resonator electrodes 20 and 40 in specific side edge portions thereof. However, such a cut-out can be provided in each distal resonator portion in either side edge portion thereof. Furthermore, the number of cuts-out need not be restricted to one but may be more than one. Also, each of the dielectric sheets 10*a* to 10*h* may be selected to have a respective required thickness, wherein the thickness of each of the sheets 10*b*, 10*c*, 10*f* and 10*g* should preferably be selected so that the amount of attenuation of reflection is optimum.

Figure 10:
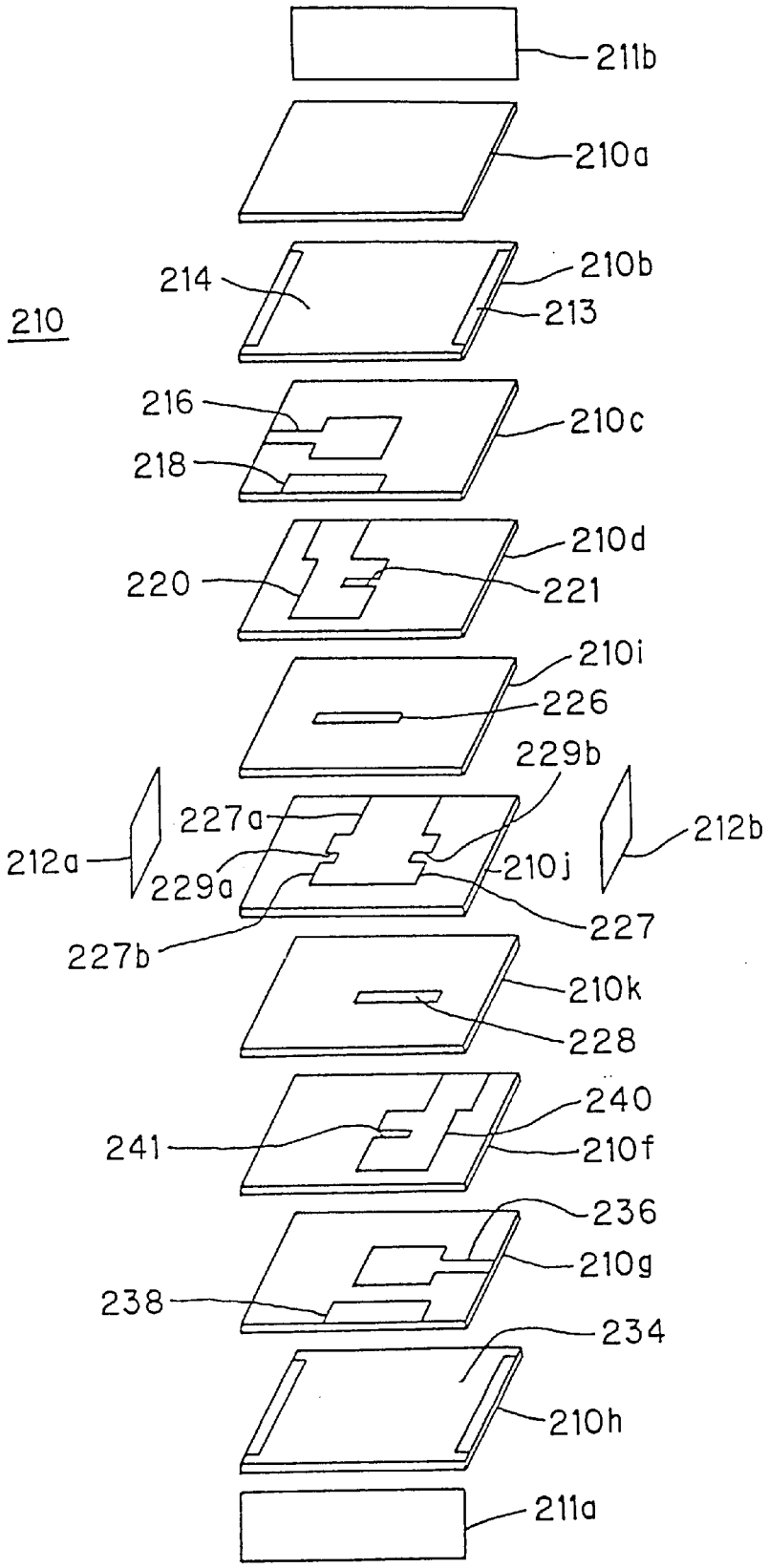
FIG. 10 is a perspective exploded view of a dielectric filter according to a second embodiment of the invention.

A dielectric filter according to a second embodiment of the present invention will now be described with reference to FIG. 10.

A dielectric filter 210 according to this second embodiment differs from the filter 10 according to the first embodiment in the following respects. In the filter 210, three dielectric sheets 210*i*, 210*j* and 210*k* are interposed between a dielectric sheet 210*d* on which a first resonator electrode 220 is provided and a dielectric sheet 210*f* on which a second resonator electrode 240 is provided. The sheets 210*i*, 210*j* and 210*k* are provide thereon with electrodes 226, 227 and 228, respectively, for the adjustment of coupling between the resonator electrodes 220 and 240.

The strip-like electrode 226 provided on the sheet 210*i* and having a predetermined length is spaced predetermined distances from ground terminal electrodes 211*a* and 211*b*, respectively, and extends in parallel therewith. The electrode 226 overlaps in part with a distal resonator portion of the resonator electrode 220 when viewed in the direction of thickness of the filter 210. The electrode 228 on the sheet 210*k* is symmetrical with the electrode 226 with reference to an imaginary plane dividing the filter 210 into right and left halves in FIG. 10.

An electrode 227 provided on the sheet 210*j* constitutes a resonator of the SI type and comprises a proximal resonator portion 227*a*, which is connected at its proximal end to a ground electrode 211*b* and extends from this ground electrode perpendicularly thereto towards the central portion of the sheet 210*j* with a constant width, and a distal resonator portion 227*b* which further extends from the proximal resonator portion with an increased constant width and has an open distal end. The distal resonator portion 227*b* has cuts-out 229*a* and 229*b* formed in both lateral edge portions thereof.

With the filter 210 according to the above-described second embodiment, advantageous effects similar to those obtained in the filter 10 of the first embodiment can be obtained. It is also possible to adjust the bandpass characteristics of the filter 210 based on positions, shapes and sizes of the electrodes 226 to 228.

What is claimed is:

1. A dielectric filter comprising at least two stripline resonators which are arranged on parallel planes, respectively, with at least one dielectric layer being sandwiched therebetween and are electromagnetically coupled to each other, said dielectric filter characterized in that each of the at least two stripline resonators comprises a first stripline portion grounded at a proximal end thereof and a second stripline portion extending from a distal end of said first stripline portion in a first direction which is in a direction where said first stripline portion extends, a width of said first stripline portion being less than that of said second stripline portion, side edges of said second stripline portion being shifted relative to respective side edges of said first stripline portion in a same direction which is perpendicular to the first direction in which said first and second stripline portions extend.

2. A dielectric filter as claimed in claim 1, wherein a shift of one of the side edges of said second stripline portion relative to a corresponding side edge of said first stripline portion is substantially zero.

3. A dielectric filter as claimed in claim 1, further comprising at least one further dielectric layer disposed outwardly of said stripline resonators on which a capacitive electrode is provided for capacitively coupling to said second stripline portion of at least one of said stripline resonators.

4. A dielectric filter as claimed in claim 1, wherein at least one strip-like tuning electrode is provided on said at least one dielectric layer sandwiched between said stripline resonators for adjustment of electromagnetic coupling between said stripline resonators, one end of said at least one strip-like tuning electrode being grounded.

5. A dielectric filter as claimed in claim 4, wherein said at least one strip-like tuning electrode comprises a first tuning electrode grounded at one end thereof and extending in a direction of said stripline resonators and at least one second tuning electrode which is in a floating state and extends in a perpendicular direction which is perpendicular to the direction in which said stripline resonators extend.

6. A dielectric filter as claimed in claim 4, wherein said at least one dielectric layer sandwiched between said stripline resonators comprises a first dielectric layer on which a first tuning electrode grounded at one end thereof and extending in a direction of said stripline resonators is provided and a second dielectric layer on which at least one second tuning electrode, which is in a floating state and extends in a perpendicular direction which is perpendicular to the direction in which said stripline resonators extend, is provided.

7. A dielectric filter comprising at least two stripline resonators which are arranged on parallel planes, respectively, with at least one dielectric layer being sandwiched therebetween and are electromagnetically coupled to each other, said dielectric filter characterized in that each of the at least two stripline resonators comprises a first stripline portion grounded at a proximal end thereof and a second stripline portion extending from a distal end of said first stripline portion in a first direction which is in a direction where said first stripline portion extends, a width of said first stripline portion being less than that of said second stripline portion, side edges of said second stripline portion being shifted relative to respective side edges of said first stripline portion in a same direction which is perpendicular to the first direction in which said first and second stripline portions extend, wherein said at least one dielectric layer has a rectangular shape when viewed in the direction of thickness thereof, said at least two stripline resonators being a pair of stripline resonators, the first stripline portion of one of these stripline resonators extending from a portion of one longer side of said at least one dielectric layer, on which this one stripline resonator is provided, near one shorter side of said at least one dielectric layer in a direction substantially perpendicular to said longer side, the second stripline portion of said one of the stripline resonators being shifted in a direction of said one shorter side of said dielectric layer with respect to said first stripline portion, another of said pair of stripline resonators being in a mirror-inverted relation to said one of said pair of stripline resonators.

8. A dielectric filter, comprising at least two stripline resonators which are arranged on parallel planes, respectively, with at least one dielectric layer being sandwiched therebetween and are electromagnetically coupled to each other, said dielectric filter characterized in that each of the at least two stripline resonators comprises a first stripline portion grounded at a proximal end thereof and a second stripline portion extending from a distal end of said first stripline portion in a first direction which is in a direction where said first stripline portion extends, a width of said first stripline portion being less than that of said second stripline portion, side edges of said second stripline portion being shifted relative to respective side edges of said first stripline portion in a same direction which is perpendicular to the first direction in which said first and second stripline portions extend, wherein at least one cut-out is formed in the second stripline portion of at least one of said stripline resonators at at least one of side edge portions thereof.

9. A method of adjusting bandpass characteristics of a dielectric filter as claimed in claim 8, wherein a depth, a width and/or a position of said cut-out is adjusted.

* * * * *